United States Patent [19]

Caverio

[11] 4,172,275

[45] Oct. 23, 1979

[54] COMBINATION LANTERN CONTAINER AND REFLECTOR DEVICE

[76] Inventor: Alfred S. Caverio, Rte. 5, Precinct St., Box 171, Lakeville, Mass. 02346

[21] Appl. No.: 938,316

[22] Filed: Aug. 28, 1978

[51] Int. Cl.[2] ..... F21L 19/00

[52] U.S. Cl. ..... 362/159; 362/191; 362/297; 362/298

[58] Field of Search ..... 362/159, 162, 157, 167, 362/190, 191, 297, 298, 301

[56] References Cited

U.S. PATENT DOCUMENTS

| | | | |
|---|---|---|---|
| 57,988 | 9/1866 | Smith | 362/162 |
| 464,486 | 12/1891 | Hoya | 362/162 |
| 1,208,059 | 12/1916 | Welch et al. | 362/159 |

*Primary Examiner*—Benjamin R. Padgett
*Assistant Examiner*—J. L. Barr
*Attorney, Agent, or Firm*—Robert J. Doherty

[57] ABSTRACT

A combination lantern container and reflector device is disclosed in which a camping lantern or similar lighting device is protected in a primary enclosure formed from a rear panel and laterally pivotal wings connected thereto. The wings and rear panel cooperatively are adapted to fully enclose the lantern on four sides and a top panel is provided at the top thereof. The lantern rests upon a platform in turn forming both the lower surface of the lantern enclosure and the upper surface of a second enclosure in which appropriate supplies for the device may be stored. A closure wall or access door of the second enclosure is maintained in a closed position by partial contact of portions of the laterally extending wings. A lantern may thus be carried and safely stored in this device in its closed position as well as being utilized in the open position wherein the wings act as light reflectors.

5 Claims, 5 Drawing Figures

COMBINATION LANTERN CONTAINER AND REFLECTOR DEVICE

BACKGROUND AND SUMMARY OF THE INVENTION

This invention relates to a container for lanterns and particularly to a combination device which may be used both as a container and reflector for presently available modern type lanterns. Such lanterns normally include a base in which a fuel source such as gasoline is housed, a mantel through which the fuel is consumed so as to produce light and a protective globe, normally glass, for enclosing and protecting the mantel. A reoccurring problem with such camping lanterns is that the mantels are fragile and may be easily damaged by rough treatment of the lantern. Also, the globes thereof can be broken upon contact with other objects or the ground. A further drawback of such devices is that they may be easily tipped over and result in the aforementioned difficulties or be further rendered inoperative because of their resultant disposition in a non-upright position.

It would accordingly be desirable to provide a lantern construction or device associated with such lantern which would avoid such commonly encountered drawbacks. A further desirable feature in lanterns or devices of this nature would also include their ability to outwardly reflect the light produced therein. In this regard, somewhat self-supporting and reflective lantern constructions are well-known; U.S. Pat. No. 25,304 issued Aug. 3, 1859 being representative thereof. Despite the availability of this and similar lantern constructions, there remains a need for a device which when associated with modern type lanterns will render such more useful for outdoor activity such as camping, fishing and the like, and which serves as a convenient and safe storage mechanism for the lantern when not in such use. The above citation and general discussion constitutes applicant's Prior Art Disclosure and in such regard, a copy of the indicated patent is enclosed with this application.

It is accordingly a primary object of the present invention to provide a device which forms a combination container and reflector for a camping lantern of the type above-indicated which will both serve as a protective enclosure for the lantern when the device is not in use and which further will enhance the utility of the lantern while the owner thereof is engaged in activities associated with camping and the like.

These and other objects of the present invention are accomplished by a device which includes a platform upon which a lantern may be detachably yet securely mounted. The platform includes an upstanding fixed position rear panel to which opposed laterally pivotal wings are attached to the opposite side edges of the rear panel in such a manner that the rear panel and the wings form a protective enclosure for the lantern in its closed position and a reflector and ground stabilizing means in the open use position thereof. The platform further forms the top wall of a second enclosure in which supplies intended with the use of the lantern may be stored such as extra mantels, matches and the like. A front wall or door panel of the second enclosure is prevented from being opened in the closed position of the primary enclosure by a pair of channeled legs downwardly extending from the wings so as to contact edge portions of the door panel.

Other objects, features and advantages of the invention shall become apparent as the description thereof proceeds when considered in connection with the accompanying illustrative drawing.

DESCRIPTION OF THE INVENTION

Figure 1:
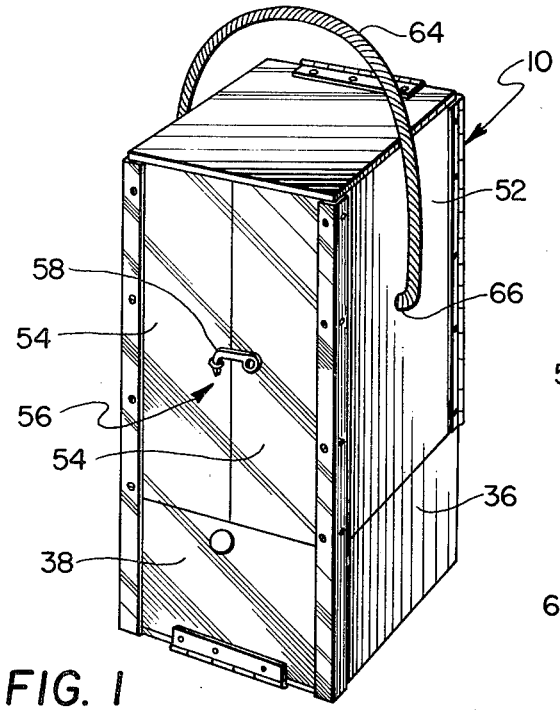
FIG. 1 is a perspective view of a device embodying the features of this invention shown in a closed storage or carrying position.
Figure 2:
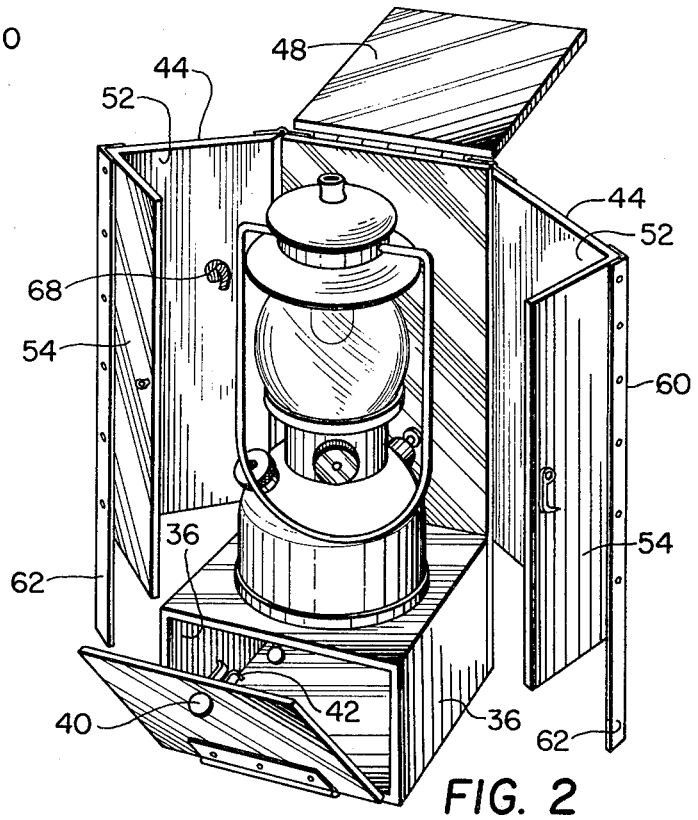
FIG. 2 is a view similar to FIG. 1 showing the device of the present invention in an open use position.
Figure 3:
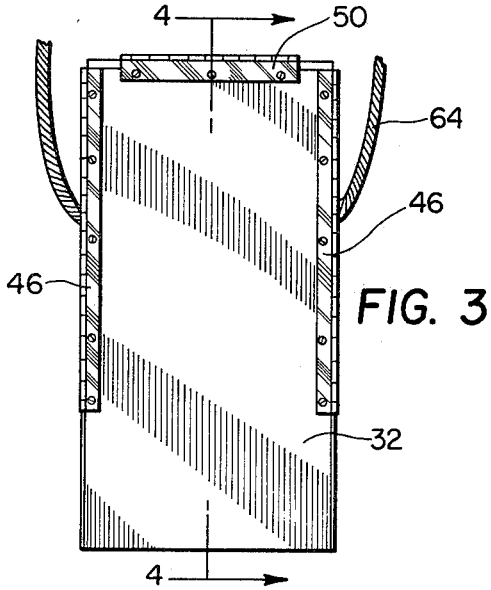
FIG. 3 is a rear view of the device shown in the closed FIG. 1 position.
Figure 4:
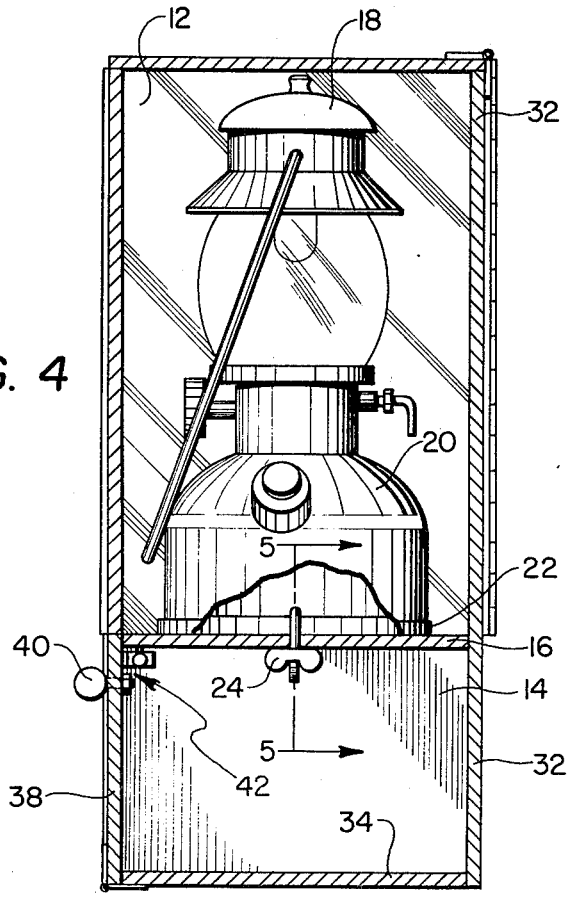
FIG. 4 is a side sectional view taken along the line 4—4 of FIG. 3.
Figure 5:
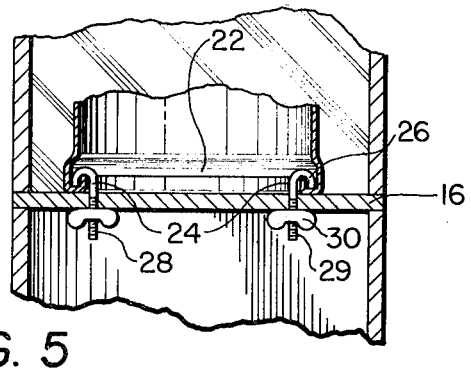
FIG. 5 is a partial front sectional view taken along the line 5—5 of FIG. 4.

The device 10 of the present invention is shown in alternate use positions in FIGS. 1 and 2 of the drawing. In FIG. 1, the device 10 is in its closed transportation or storage attitude while in FIG. 2, the device is displayed in a somewhat stylized manner as when utilized for lighting at a camp or fishing site. The device includes an upper or primary enclosure 12 and a lower or second enclosure 14. A generally planar panel 16 of generally rectangular configuration is common to both enclosures 12, 14, and in that regard forms a base platform for the upper enclosure and an upper wall for the lower enclosure 14.

A lantern 18 of conventional configuration and having a base 20 including an inwardly turned lower flange 22 is mounted on the platform 16 by means of a pair of clamps 24. One end of the clamps includes a hook 26 adapted to engage the inwardly turned flange 22 of the lantern 18. The body of the clamp passes entirely through the platform 16 by means of openings 28 provided therethrough. The other end 29 of the clamps is threaded and serves to engage a wing nut 30 such that the hooked end of the clamp can be tightened against the flange 22 so as to securely attach the lantern 18 to the platform 16 in a position generally centrally thereof. As will hereinafter become apparent, the various remaining panels serving to form the upper enclosure 14 are positioned out of contact with the lantern and thus serve to protect it from being damaged during shipment or storage in the closed position as illustrated in FIG. 1.

The device includes a vertically orientated rear panel 32 from which the platform 16 outwardly extends generally at right angles thereto partway up the vertical extent thereof. The rear panel 32 thus serves to form the rear wall of both the upper and lower enclosures 12, 14 respectively. A base wall 34 outwardly extends from the lower edge of the rear panel 32 in a similar fashion to the platform 16 and is accordingly downwardly spaced therefrom. Side walls 36 upwardly extend between the base wall 34 and the platform 16. The enclosure 14 further includes a front wall or closure 38 hingedly connected to the front edge of the base wall 44 and pivotal with respect thereto so as to form opening access to the enclosure 14. The front wall is further provided with a finger pull 40 and a spring locking device 42 of known configuration such that the front wall may be opened and closed so as to gain access to the enclosure 14. The enclosure 14 is suitable for the storage of extra mantels, matches and similar lantern and camping related items when the device is disposed in its open use position as shown in FIG. 2 of the drawings.

The rear panel 32 is further provided with a pair of laterally extending wings 44 each in turn hingedly connected to a side edge of the panel 32 by means of hinges 46. Additionally, a top panel 48 is similarly connected to the rear panel 32 by means of a hinge structure 50. Each of the wings 44 in turn includes a side panel portion 52 and a front panel portion 54 extending at right angles thereto. Each of the front panel portions 54 serve to form approximately one-half of a composite front panel 56 as shown in FIG. 1 and locking means 58 are provided on the respective front panel portions 54 so as to maintain such in side-by-side position such as shown in FIG. 1, when the device is in its closed storage or transportation position. While in such position, it should be noted that that portion of a right angle bracket 60 which in turn serves to connect the side and front panel portions 52, 54 respectively of each of the wings 44 extends below the wings so as to form legs 62. The legs 62 in turn overlap portions of the front panel 38 in the closed position and as best shown in FIG. 1 such that access to the second enclosure 14 is prevented in the storage position of the device 10.

Additionally, the inner surfaces of the wings 44 as well as the rear wall 32 are provided with a polished or reflective surface such that when the device is in its extended position shown in FIG. 1 with the legs 62 and the base wall 34 cooperating to support the device in its lighting position, light given off by the lantern 18 will be magnified or directed in the manner intended by its user by his or her proper manipulation of the extent to which the wings 44 are outwardly displaced with regard to the rear panel 32. Additionally, a looped carrying strap 64 is provided so as to enable the device to be easily carried. Each end of the strap 64 passes through an opening 66 provided at one of the side panel portions 52 and terminates in a knot 68.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination lantern container and reflector device comprising a platform including means for detachably mounting the base of said lantern to said platform, a fixed rear panel having an inner reflective surface upstanding from the rear edge of said platform, said rear panel including side and front panel wing portions forming opposed wings, said wing panel portions also having inner reflective surfaces, said wings hingedly connected to said rear panel along opposite edge portions of said rear panel for respective pivotal movement from an open reflector position of said device to a closed position wherein said platform, said rear panel and said wings form a composite enclosure for said lantern, said rear panel having a continuing portion extending below said platform, said platform having downwardly extending spaced opposed side walls, said side walls and said rear panel continuing portion further in part forming a second enclosure positioned beneath said lantern enclosure, said second enclosure also including a fixed base wall downwardly spaced from said platform and said opposed side walls connecting said base wall to said platform, said second enclosure in turn including a front closure wall through which access to said second enclosure may be gained, each of said wings having a leg longitudinally extending downwardly below said platform and terminating in an end substantially in line with the base wall of said second enclosure such that said legs and said second enclosure base wall support said device in an upwright position, said wing panel legs adapted to contact front surface portions of said front closure wall when said wings are disposed in their closed position so as to prevent said closure wall from being opened in such closed position.

2. The device of claim 1, wherein said front closure wall is hingedly connected to said base wall for pivotal movement with respect to the front edge thereof.

3. The device of claim 1, said means for detachably mounting said lantern base to said platform including a pair of hook clamps passing through said platform and having threaded portions extending into said second enclosure whereby said clamps may be hand-tightened from said second enclosure.

4. The device of claim 1, said wing panel legs being right angle channel extensions positioned at the forward edge of the side panel portion of each of said wings.

5. The deivce of claim 4, said front panel being split with composite parts thereof attached to the forward edge of the said panel portions of each of said wings.

* * * * *